United States Patent [19]

Toyoshima

[11] Patent Number: 4,883,434

[45] Date of Patent: Nov. 28, 1989

[54] WEDGE-BASE LAMP AND SOCKET ASSEMBLY

[75] Inventor: Akira Toyoshima, Shiki, Japan

[73] Assignee: Stanley Electric Co., Ltd., Tokyo, Japan

[21] Appl. No.: 273,191

[22] Filed: Nov. 17, 1988

[30] Foreign Application Priority Data

Oct. 7, 1988 [JP] Japan ..... 63-253431

[51] Int. Cl.[4] ..... H01R 17/00

[52] U.S. Cl. ..... 439/619; 439/699; 439/375; 313/318

[58] Field of Search ..... 439/611, 612, 613, 614, 439/615, 617, 618, 619, 616, 356, 699; 313/315, 317, 318

[56] References Cited

U.S. PATENT DOCUMENTS 3,676,834 7/1972 Kaldor et al. ..... 439/356 X 4,028,577 6/1977 Gates et al. ..... 313/318

*Primary Examiner*—Neil Abrams

*Assistant Examiner*—Khiem Nguyen

*Attorney, Agent, or Firm*—Frishauf, Holtz, Goodman & Woodward

[57] ABSTRACT

A wedge-base lamp and socket assembly includes a wedge-base lamp having a pair of projections formed on opposite sides near the center of a base of the wedge-base lamp; and a socket having a pair of resilient arms which come in engagement with the pair of projections when the wedge-base lamp is mounted within the socket. A single filament type wedge-base lamp has fool-proof projections formed on opposite sides at opposite end portions of the base, and a double filament type wedge base socket has abutment portions which come in engagement with the fool-proof projections when the single filament type wedge-base lamp is inserted into the double filament type socket to thereby prevent erroneous coupling therebetween.

3 Claims, 4 Drawing Sheets

WEDGE-BASE LAMP AND SOCKET ASSEMBLY

FIELD OF THE INVENTION

The present invention relates to an assembly of a wedge-base lamp and a socket for receiving therein the wedge-base lamp.

DESCRIPTION OF THE PRIOR ART

A conventional assembly of a wedge-base lamp 21 and a socket 31 is shown in FIG. 6. The wedge-base lamp 21 has a base 21*a* on which lead wires 21*b* are folded back. The socket 31 comprises a socket main body 31*b* made of resin or the like and plate-like electrode contacts 31*a* mounted within the socket main body 31*b* for electrical connection to the lead wires 21*b*. The electrode contacts 31*a* tightly hold the base 21*a* of the wedge-base lamp 21 while ensuring electrical and mechanical connection between the lamp 21 and the socket 31.

Wedge-base lamps 21*a* need not have specific plugs, which results in improved manufacture and cost effectiveness. Thus, they have wide application to such as vehicle head lamps and the like. However, with the advent of large wedge-base lamps, and wedge-base lamps having double filaments, there arise some problems associated with the conventional lamp and socket assembly. First, the ability of a socket to hold a lamp becomes poor over a period of time, so that the lamp may be accidentally removed therefrom while being used. Second, a single filament type wedge-base lamp may be erroneously mounted in a double filament type socket. Thus, a fatal defect, such as no operation of one of a stop lamp and a tail lamp, may happen. The above problems have been desired to be solved.

SUMMARY OF THE INVENTION

It is therefore an object of the present invention to provide a novel wedge-base lamp and socket assembly capable of solving the above problems.

The above object is achieved by the wedge-base lamp and socket assembly of this invention, which comprises a wedge-base lamp having a pair of projections formed on opposite sides near the center of a base of said wedge-base lamp; and a socket having a pair of arms which come into engagement with said pair of projections when said wedge-base lamp has fool-proof projections formed on opposite sides at opposite end portions of said base, and a double filament type wedge-base socket has abutment portions which come into engagement with said fool-proof projections when said single filament type wedge-base lamp is inserted into said double filament type socket thereby preventing erroneous coupling therebetween.

DETAILED DESCRIPTION OF THE EMBODIMENTS

Figure 1:
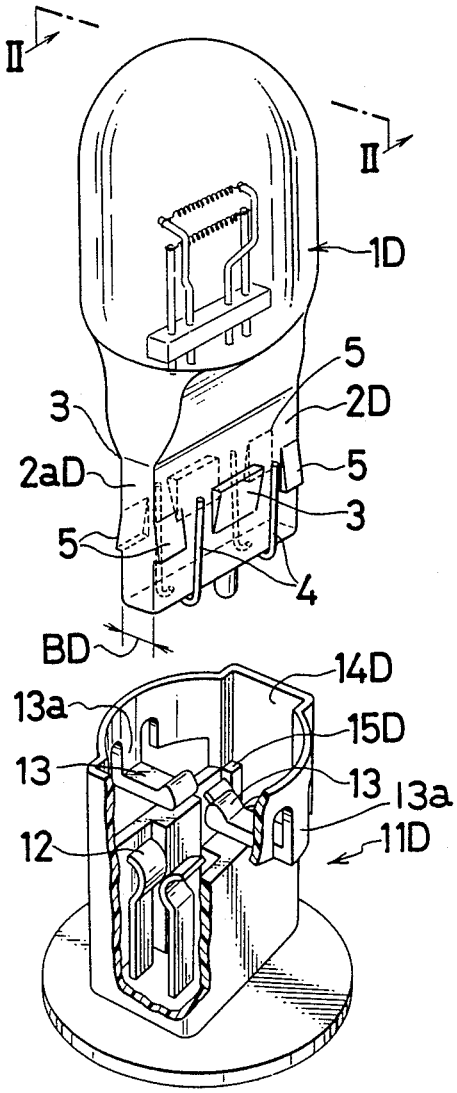
FIG. 1 is a perspective, partly broken away view showing an embodiment of an assembly of a double filament type wedge-base lamp and a double filament type socket according to the present invention.

FIG. 1 shows an assembly of a double filament type wedge-base lamp 1D (hereinafter abbreviated as double wedge-lamp 1D) and a double filament type socket 11D (hereinafter abbreviated as double socket 11D) for receiving the double wedge-lamp 1D.

A pair of wedge-like projections 3 are formed on the base 2D of the double wedge-lamp 1D on opposite sides near the center thereof.

The double wedge-lamp 1D has four lead wires 4 folded back on the base 2D. Four wire guides 5 are formed on opposite sides of the base 2D and extend from side edges 2*a*D of the base 2D toward the projections 3 with suitable clearances therebetween within which the lead wires 4 are positioned, as seen in FIG. 1.

The double socket 11D is formed with four plate-like electrode contacts 12 for contacting with the respective lead wires 4, and a pair of arms 13 for respective engagement with the pair of projections 3.

The side guide grooves 14D and abutment portions 15D of the socket 11D will be later described with reference to FIGS. 4 and 5.

Figure 2:
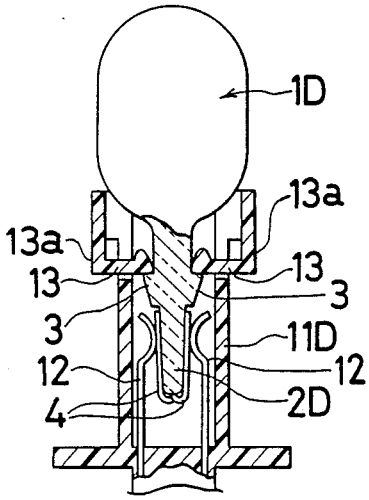
FIG. 2 is a sectional view taken along line II—II as shown in FIG. 1.

FIG. 2 shows the positional relation between the projections 3 and the arms 13, with the double wedge-lamp 1D being inserted in the double socket 11D, and with the projections 3 being in engagement with the arms 13. The projections 3 of generally wedge-like shape as shown in FIGS. 1 and 2 operate when they come into engagement with the arms 13, such that the lamp 1D can be easily inserted within the socket 11D, whereas on the other hand the socket 11D has an ability to securely hold the lamp 1D to thus prevent the lamp 1D from being removed therefrom under operating conditions due to vibrations or the like. In order to further facilitate the insertion of the lamp 1D within the socket 11D, the arms 13 are integrally formed with curved spring plates 13A (see FIG. 1) which are connected to the double socket 11D only at opposite upper end portions thereof.

Figure 3:
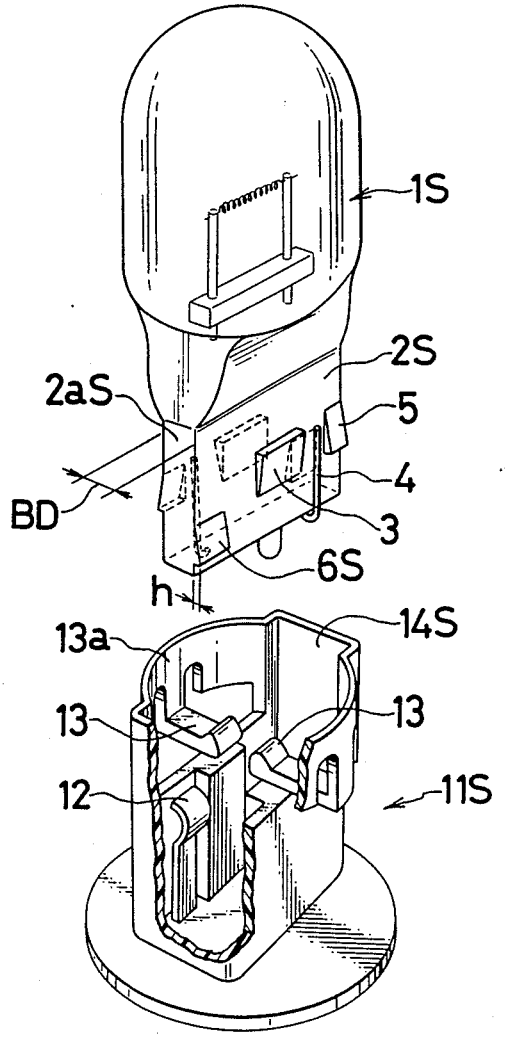
FIG. 3 is a perspective, partly broken away view showing an embodiment of an assembly of a single filament type wedge-base lamp and a single filament type socket according to the present invention.

FIG. 3 shows an assembly of a single filament type wedge-base lamp 1S (hereinafter abbreviated as single wedge-lamp 1S) and a single filament type socket 11 (hereinafter abbreviated as single socket 11S) for receiving the single wedge-lamp 1S.

A pair of wedge-like projections 3, similar to the projections 3 described with reference to the double wedge-lamp 1D, are formed on the base 2S of the single wedge-lamp 1S, two lead wires 4 are used so that a pair of wire guides 5 are formed on opposite side of the base 2S at opposite end portions of the base 2S.

The base 2S also comprises a pair of fool-proof projections 6S having a similar configuration to that of the wire guides 5, and positioned on opposite sides of the base 2S, at opposite end portions near the lower end portion of the base 2S where no wire guide 5 is formed.

Similar to the double socket 11D, the single socket 11S is also provided with only a pair of plate-like electrode contacts 12 for making electrical contact with the respective lead wires 4, and also with a pair of arms 13. Also, guide groove 14S similar to the guide grooves 14D of the double socket 11D are provided.

The fool-proof projections 6S function to prevent erroneous coupling between the double socket 11D and the single wedge-lamp 1S. In view of this, the double socket 11D and single socket 11S have constructions as described below.

Figure 4:
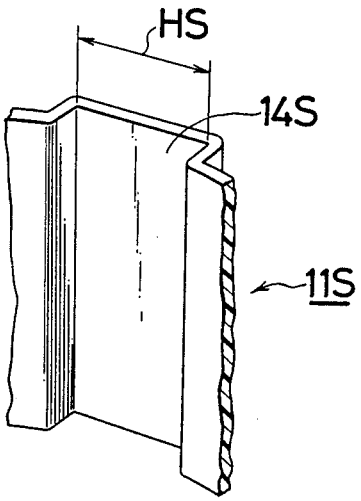
FIGS. 4 and 5 are enlarged fragmentary views showing main parts of the embodiments shown in FIGS. 1 and 3, respectively.

In particular, FIG. 4 shows a guide groove 14S of the single socket 11S, which is formed with a suitable depth (See FIG. 3) at opposite end portions of the single socket 11S and along which the opposite ends 2aS (FIG. 3) of the base 2S are guided. The width HS of the groove 14S is the sum of the thickness BD of the base 2S and twice the height h (FIG. 3) of the fool-proof projection 6S.

Figure 5:
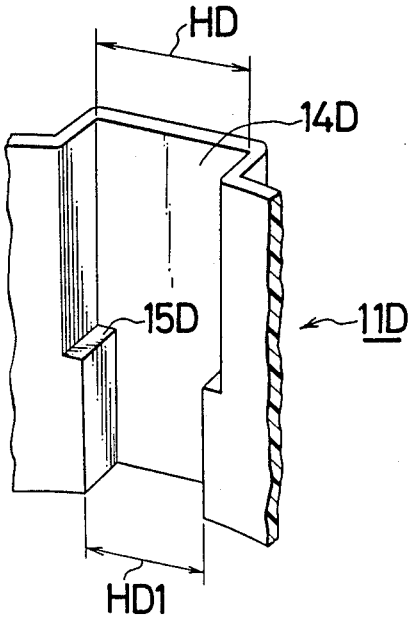
Figure 6:
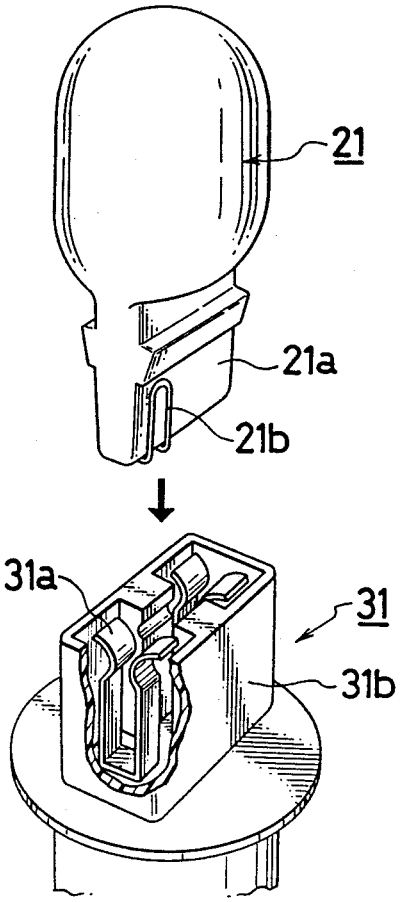
FIG.6 PRIOR ART
FIG. 6 is a perspective view showing a conventional wedge-base lamp and socket assembly.

Contrary to the guide groove 14S of FIG. 4, although the guide groove 14D of the double socket 11D shown in FIG. 5 is formed at a position and with a configuration generally similar to the guide groove 14S and has the width HD which is the same as that of the width HS, and abutment portions 15D are formed at the lower portion of and within the guide groove 14D, as seen in FIG. 5. The abutment portions 15D may have the same depth as the depth of the guide groove 14D, or smaller than that. The width or spacing HD1 between opposite abutment portions 15D within the guide groove 14D is set substantially equal to the thickness BD of the bases 2S, 2D. Therefore, the overall thickness of the base 2S plus the fool-proof projection 6S approximately equals the width HS of the guide groove 14S which is larger than the width HD1 between opposite abutment portions 15D.

With such an arrangement, the double wedge-lamp 1D can be inserted in the single socket 11S, whereas the single wedge-lamp 1S cannot be inserted fully with the double socket 11D because the fool-proof projections 6S and the abutment portions 15D abut with each other.

The above embodiment has been described in order to explain the gist of the invention. Various modifications are possible. For example, the fool-proof projections may be formed on opposite sides at one end portion of the base, or on one side at opposite end portions of the base. The gist of the invention accordingly resides in that the fool-proof projections are formed on the single wedge-lamp 1S to prevent the latter from being fully inserted within the double socket 11D.

As described so far, the wedge-base lamp is formed with projections 3 on its base, and the socket is formed with arms 13 which come into engagement with the projections when the lamp is inserted within the socket. Therefore, the problem of insufficient ability of the socket to hold the lamp can be solved, thus preventing removal or falling out of a recent large wedge-base lamp due to vibration or the like while being used. Further, the single wedge-lamp is formed with a fool-proof projection. Therefore, the single wedge-lamp cannot be inserted fully within the double socket to thus prevent erroneous coupling therebetween and hence a fatal operating defect. The present invention has wide application to lamps, such as large wedge-base lamps and double filament lamps, allowing improved cost effectiveness, etc.

I claim:

1. A wedge-base lamp and socket assembly in which a double filament socket excludes the entry of a single filament lamp, comprising:

a wedge-base lamp having an envelope containing at least one filament therein, a wedge base coupled to said envelope, and a pair of projections formed on opposite sides of said wedge base near the center of said wedge base;

a socket for receiving a wedge base of a wedge-base lamp therein, said socket having a pair of arms which are engageable with said pair of projections of said wedge-base lamp when said wedge base of said wedge-base lamp is mounted within said socket;

and wherein said wedge-base lamp is of the single filament wedge-base type and has a fool-proof projection on said base thereof; and wherein said socket is a double filament type wedge-base socket and has an abutment portion therein which is abuttingly engageable with said fool-proof projection of said single filament type wedge-base lamp when said single filament type wedge-base lamp is inserted into said double filament type wedge-base socket, to prevent full entry of said single filament type wedge-base lamp into said double filament type wedge-base socket, thereby preventing erroneous coupling between a single filament type wedge-base lamp and a double filament type wedge-base socket;

and wherein said abutment portion of said double filament type wedge-base socket is arranged such that when a double filament type wedge-base lamp is used in place of said single filament type wedge-base lamp, said double filament type wedge-base lamp being free of said fool-proof projection so that full entry of said double filament type wedge-base lamp into said double filament type wedge-base socket is permitted without said abutting engagement.

2. The wedge-base lamp and socket assembly of claim 1, wherein:

said single filament type wedge-base lamp has fool-proof projections on both opposite sides and at opposite end portions of said wedge base; and said double filament type wedge-base socket has abutment portions which are respectively abuttingly engageable with said fool-proof projections when said single filament type wedge-base lamp is inserted into said double filament type wedge-base socket.

3. The wedge-base lamp and socket assembly of claim 1, wherein:

said single filament type wedge-base lamp has fool-proof projections on one side and at opposite end portions of said wedge-base; and said double filament type wedge-base socket has abutment portions which are respectively abuttingly engageable with said fool-proof projections when said single filament type wedge-base lamp is inserted into said double filament type wedge-base socket.

* * * * *